US005347267A

United States Patent [19]

Murray

[11] Patent Number: 5,347,267

[45] Date of Patent: Sep. 13, 1994

[54] ELECTRONIC LOCK RESET SYSTEM AND METHOD

[75] Inventor: James S. Murray, South Lyon, Mich.

[73] Assignee: Stanley Home Automation, Novi, Mich.

[21] Appl. No.: 951,814

[22] Filed: Sep. 28, 1992

[51] Int. Cl.[5] ..... E05B 49/00

[52] U.S. Cl. ..... 340/825.31; 361/172; 70/278

[58] Field of Search ..... 340/825.31, 825.56; 361/172; 70/278

[56] References Cited

U.S. PATENT DOCUMENTS

| | | | |
|---|---|---|---|
| 3,688,269 | 8/1972 | Miller . | |
| 3,751,718 | 8/1973 | Hanchett, Jr. . | |
| 3,761,892 | 9/1973 | Bosnyak et al. . | |
| 3,821,704 | 6/1974 | Sabsay | 340/825.31 |
| 3,926,021 | 12/1975 | Genest et al. | 340/825.31 |
| 3,944,976 | 3/1976 | France . | |
| 3,984,658 | 10/1976 | Cannon . | |
| 4,209,782 | 6/1980 | Donath et al. | 70/278 |
| 4,392,133 | 7/1983 | Lundgren . | |
| 4,646,080 | 2/1987 | Genest et al. . | |
| 4,684,945 | 8/1987 | Sanderford, Jr. . | |
| 4,849,749 | 7/1989 | Fukamachi et al. . | |
| 4,972,182 | 11/1990 | Novik et al. . | |
| 5,055,658 | 10/1991 | Cockburn . | |

FOREIGN PATENT DOCUMENTS 1003965 5/1973 Canada .

*Primary Examiner*—Michael Horabik

*Attorney, Agent, or Firm*—Krass & Young

[57] ABSTRACT

A group of cabinets or other units each have a solenoid operated lock controlled by an electronic lock accessible by one or more electronic keys. The locks are linked together in a chain by power and data lines so that power is supplied through a single 12 volt transformer, and key codes are transmitted from a lock that reads a key to other locks, to open any cabinet programmed with an access code matching the transmitted key code. To limit power requirements, when one solenoid is being energized a busy signal is transmitted to prevent concurrent operation of other solenoids. A user installed master code stored in the lock and a corresponding master key are used to permit programming or erasing of other access key codes. A factory installed permanent reset code is stored in the lock and a secret algorithm known only to the manufacturer can derive the reset code from the cabinet serial number. When a master key is lost the user requests a reset key from the manufacturer who must use the secret algorithm to reveal the reset code and make a key containing the reset code. When that key is used, the master and access codes are erased, the lock is opened and the code in the reset key is scrambled to prevent its use for another reset operation.

6 Claims, 6 Drawing Sheets

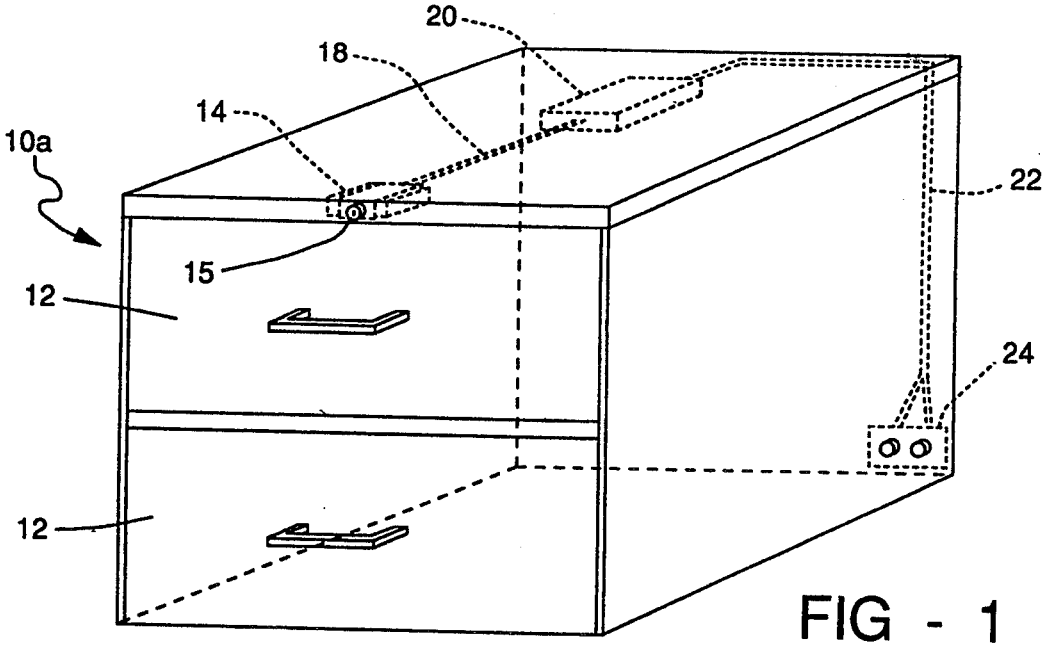
FIG - 1
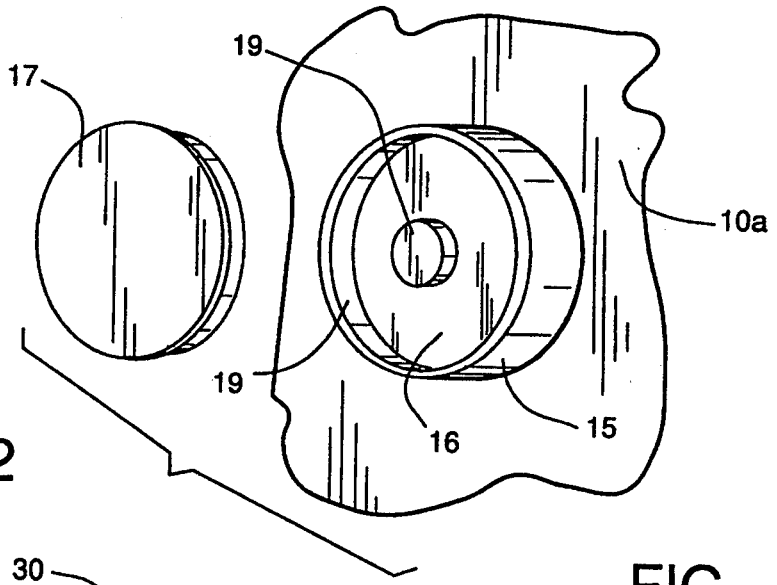
FIG - 2
FIG - 3b
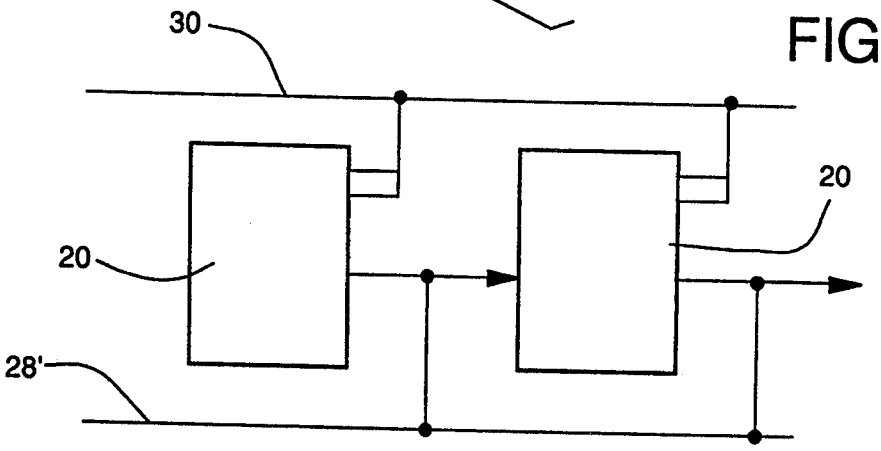

C
72
NEW BUTTON ?
NO
YES
74
RESET CODE ?
YES
76
ENTER RESET MODE
NO
78
MASTER CODE ?
YES
80
ENTER LEARN MODE
NO
82
ACCESS CODE ?
YES
84
UNLOCK CABINET
NO
B
86
BUTTON IN SOCKET ?
YES
90
BUTTON IN FLAG = 1 ?
YES
93
NEW BUTTON FLAG = 0
NO
NO
88
BUTTON IN FLAG = 0
92
BUTTON IN FLAG = 1
NEW BUTTON = 1
A

ELECTRONIC LOCK RESET SYSTEM AND METHOD

FIELD OF THE INVENTION

This invention relates to an electronically controlled lock system and particularly to a secure resettable lock system and a method of resetting an electronic lock.

BACKGROUND OF THE INVENTION

Electronic locks are well known and are useful for securing doors, cabinets, desks or other types of units. Such locks have keys with magnetically or electronically stored key codes which are readable by the locks and permit opening of a lock when the key code corresponds to an access code stored in the lock. Each lock may be furnished with several access codes so that several unique keys will open the lock and each key may open more than one lock. To allow authorized users to determine which keys will match a given lock, a programming procedure is provided.

One key for each lock is designated as a master key and its key code is stored in the lock as a master code. When the master key is presented to the lock and then another key is presented, the lock is enabled to learn access codes from the other key. The master key is also useful to erase access codes and even the master code when key changes are desired. If, however, the master key is lost, or is obtained by an unauthorized person, key code changes are necessary but cannot be accomplished by the usual method. It is then important to be able to reset the lock to allow a new master code to be entered. It is equally important that only approved persons be able to use the reset procedure.

SUMMARY OF THE INVENTION

The electronic lock system comprises a microcomputer based control which is equipped with nonvolatile memory. A reset code is permanently stored in that memory. A secret algorithm for obtaining the reset code from the serial number of the lock or the unit containing the lock is maintained by the manufacturer, and the reset code is not normally supplied to the purchaser of the lock or the unit containing the lock. In addition, the memory, which may be an electrically erasable programmable read-only memory or EEPROM, has addresses for a master code and access codes which are supplied by the user and may be changed. For programming purposes the lock has a pushbutton which is accessible only when the unit is open. A number of keys, each having a unique key code are available. For initial programming the pushbutton is depressed and any key is presented to the lock; its key code is stored as the master code and thus master key. Access codes are installed into the lock by first presenting the master key and then another key, and its key code will be stored as an access code. This is repeated for each key to be used for access. Change of the master code is possible by use of the master key along with the pushbutton, thus requiring that the lock be open.

When all access keys are lost or the master key is lost the master code cannot be changed in the usual way. Then the reset procedure is used. A reset key must be obtained from the manufacturer by furnishing the serial number. The manufacturer then derives the reset code for that unit from the serial number and the secret algorithm, and encodes it into a key which is delivered to an authorized representative of the user. By presenting the reset key to the lock, the microcomputer verifies that the reset key code matches the reset code in the EEPROM and then scrambles the key code to prevent another use of the reset key, erases the master and access codes from the memory, and opens the lock.

BRIEF DESCRIPTION OF THE DRAWINGS

The above and other advantages of the invention will become more apparent from the following description taken in conjunction with the accompanying drawings wherein like references refer to like parts and wherein:

FIG. 1 is an isometric view of a cabinet including an electronically controlled lock according to the invention;

FIG. 2 is an isometric view of an electronic key and a key receptor on the cabinet of FIG. 1;

FIGS. 3*a* and 3*b* are schematic diagrams of a plurality of cabinets with interconnecting locks, according to the invention;

DESCRIPTION OF THE INVENTION

Figure 3A:
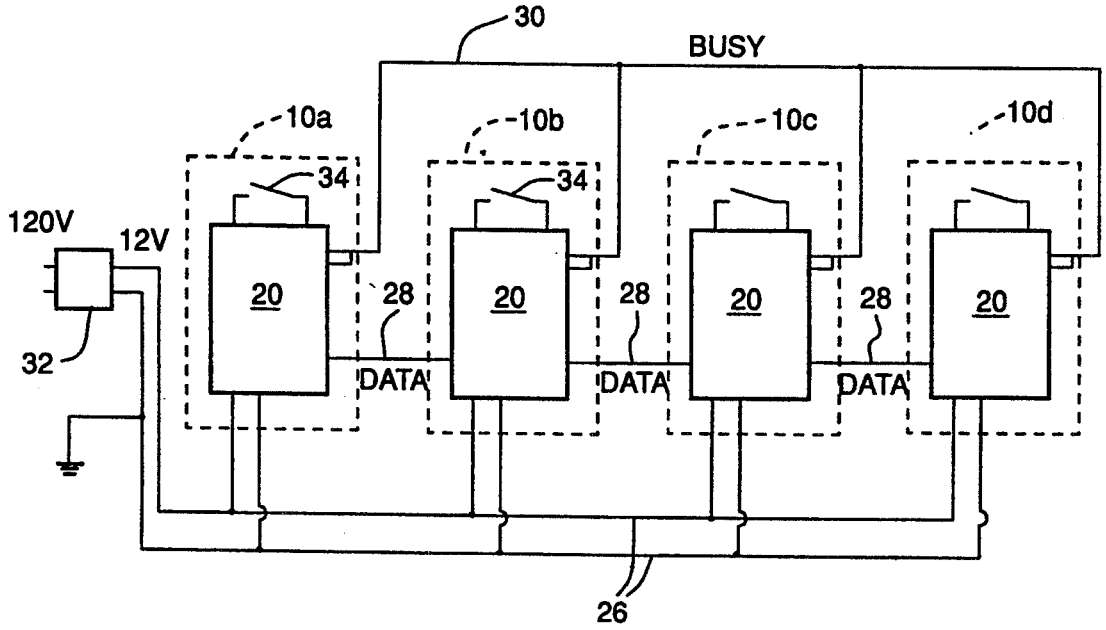

While the ensuing description is couched in terms of a lock system for file cabinet, desks, and other office furniture, it applies as well to computers or other appliances and to doors controlling access to rooms, for example. The term "unit" is used herein to mean any item controllable by an electronic lock and connectable into a system of locks.

Referring to FIG. 1, a file cabinet 10*a* has drawers 12 which are locked by a well-known mechanism 14 operable to locked position by a manually depressible plunger 15 and to an open position by a solenoid within the mechanism 14. The lock mechanism 14 is electrically connected by conductors 18 to an electronic lock 20. Both the mechanism 14 and the electronic lock 20 are secured to the inside upper portion of the cabinet 10*a* and are accessible only when the upper drawer is open, except for the plunger 15 which protrudes through the front face of the cabinet. The plunger 15 (FIG. 2) has a front socket 16 for receiving an electronic button 17 or key which engages electrodes 19 on the plunger for communication with the lock 20 via the conductors 18. The lock 20 is connected by lines 22 to connectors 24 in the rear of the cabinet for coupling to a power supply and to other cabinets or other locked units. The key or code button 17 is a two electrode coin-shaped can containing a nonvolatile chip which can read or write to the lock 20 on contact with the socket 16. The key stores a large digital number which is the key code. Such, devices are, for example, DS199X Touch Memories available from Dallas Semiconductor Corp., Dallas, Tex. For convenience the buttons may be mounted on an identification card or on a key chain attachment.

The cabinet 10*a* is electrically connected to other cabinets 10*b*, 10*c* . . . 10*n* as shown in FIG. 3*a*, the cabinets being connected by power and common lines 26, data lines 28, and a common busy line 30. The first cabinet 10*a* in the series is connected through a 12 volt transformer 32 to a 120 volt line. The 12 volt output is coupled across the power and common lines 26. The data line 28 of the first cabinet is connected only to the second cabinet, etc., so that the data is coupled serially from on cabinet to the next. Each electronic lock 20 in the several cabinets is physically the same but individually programmable with different access codes. Each lock also is equipped with a pushbutton switch 34 which is manually operable and accessible only when the top drawer 12 is open.

Figure 4:
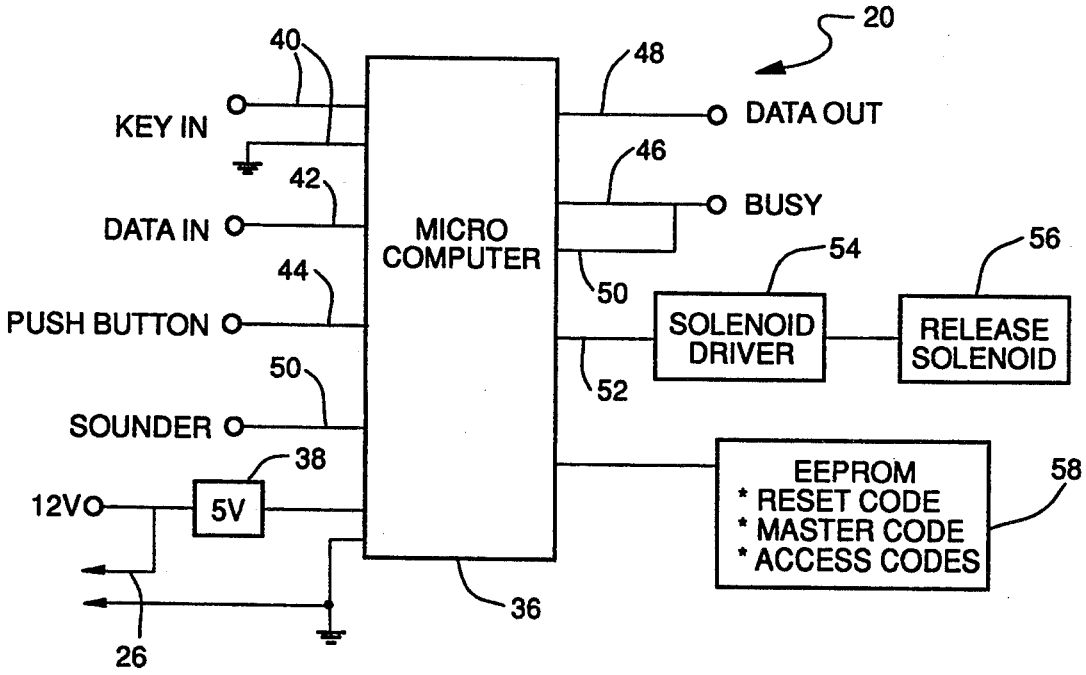
FIG. 4 is a schematic diagram of microcomputer based lock circuitry according to the invention.

FIG. 4 shows the electronic lock circuit 20 which features a microcomputer 36, such as an MC68HC05P9 supplied by Motorola Semiconductor Products, Inc., Phoenix, Ariz. The microcomputer is powered by a 5 volt regulator circuit 38 having an input from the 12 volt line 26. Other inputs comprise a line pair 40 from the electrodes 19 of the socket 16 which carry the key code from the button 17, a "data in" line 42 which receives data from other locks 20 via line 28, a push button input 44 from the pushbutton switch 34, and a busy input 46. Outputs of the microcomputer 38 are "data out" terminal 48 for supplying data to line 28, a busy out terminal 50 coupled to line 30 along with input 46, a sounder output 50, and finally, an unlock output 52 connected to a solenoid driver 54 which furnishes actuating current to a release solenoid 56. A non-volatile memory 58 is also coupled to the microcomputer. Preferably the memory is an electrically erasable programmable read-only memory or EEPROM. The memory has a factory installed, permanently stored reset code, and addresses for a master code and many access codes to be installed by the user. The microcomputer, when properly programmed will read the key code of any key button inserted into the socket 16 and energize the solenoid driver 54 to unlock the cabinet when a valid access key code is received. At the same time, it will output the key code at terminal 48 for transmission to another lock 20; optionally only those key codes that are valid for the reading microcomputer are transmitted. The microcomputers that are not reading the button code receive the transmitted key code and open any locks for which the key code is valid. Whenever any solenoid driver 54 is being activated, a busy signal is sent via lines 30 to the other locks to prevent other solenoid drivers from operation at the same time, thereby minimizing peak current load on the 12 volt supply system.

A complete system thus includes a plurality of cabinets or other units 10*a* . . . 10*n*, each having an electronic lock 20, the cabinets being linked together in daisy chain style by transmission lines, and a plurality of key buttons, each having a unique code stored therein. The serial communication link enables the data output of one lock to be coupled to the data input of one other lock, and the other lock is connected in the same way to yet another lock, so that the data flows in just one direction. Such an arrangement permits a key code to be read by any lock and be sent to other locks "downstream". FIG. 3*b* shows a parallel style of communication link wherein a data line 28' is connected to all data inputs and outputs so that all transmitted key codes are available to all the locks. Although it is preferred that a plurality of units are linked together by a transmission line, alternative communication links can be used for data coupling, for example, infrared signals, ultrasonic signals, radio signals, etc.

The microcomputer is programmed to store and respond to three different types of codes. A reset code is permanently stored in the EEPROM at the time of manufacture of the cabinet. All other codes are also stored in the EEPROM and are programmed by the user. Each cabinet has a master code and one or more access codes. To program a master code, the top drawer 12 must be open and the pushbutton 34 manually depressed. Then any button is inserted into the socket 16 and that key code is stored in the EEPROM as the master code for that unit, and that button becomes a master button. Each cabinet may have a different master code or a shared one, depending on the security arrangements of the user.

Access codes can be programmed into the lock when the drawer is closed and either locked or unlocked. First the master button is presented to the lock to initiate a learn mode and then another button is presented to the lock. The code of the other button is stored in the EEPROM as an access code for that specific lock. The process may be repeated for additional buttons to store their key codes as access codes in the EEPROM. If desired, some or all of the same access codes may be used for other cabinets. Thus it is possible to establish a hierarchy of users within an organization: only a few will be allowed to have master buttons, others will have buttons accessing many units, and still other will have buttons accessing only a few units.

The master buttons are used to program new access codes as described, and can also be used to erase all the existing access and master codes in the EEPROM. This is effected by depressing the pushbutton 34, holding the master button in its socket for a predetermined time, and presenting another button to become a new master.

Figure 5:
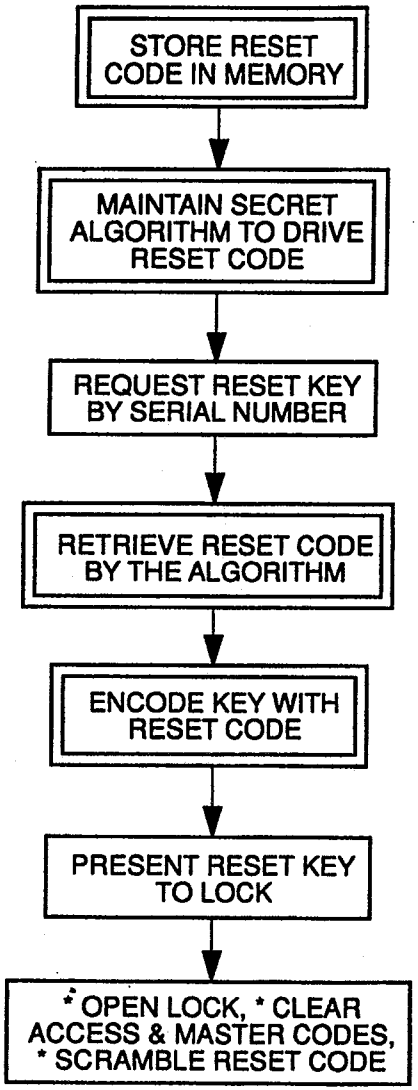
FIG. 5 is a chart illustrating the process of managing the reset key code and providing a reset key.
Figure 6B:
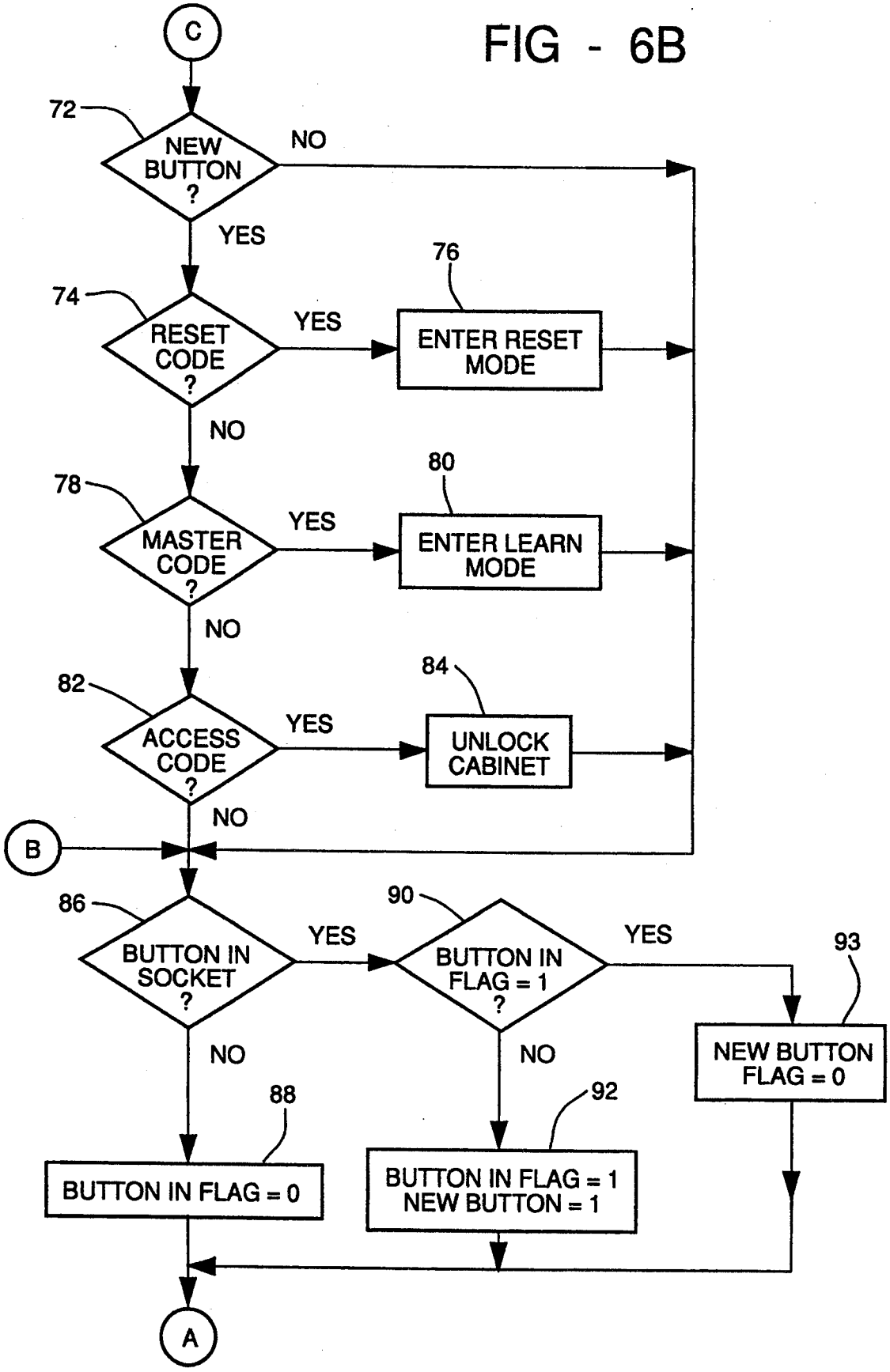

The manufacturer maintains a secret algorithm which derives the reset code from the serial number of the cabinet. Ordinarily, the user has full control of the keys and does not have to use the reset code. However, if a master key or button is lost, the ability to reprogram a unit is also lost. In that case, a button programmed with the reset code is obtained from the manufacturer. The manufacturer must use the secret algorithm to determine the reset code corresponding to the serial number and encode a key with the reset code. The button is placed in the socket of the unit and the microcomputer compares the code to the reset code stored in the EEPROM, and, if a match is obtained, the reset code is scrambled and written into the button, the unit is unlocked, and the master and access codes in the EEPROM are erased. Thus the lock is restored to new condition and may be reprogrammed with new master and access codes. Since the reset button is programmed with a new code, it becomes an ordinary key and may be used as a master or access button. This one-time reset button minimizes the risk of someone having a key with a code that cannot be erased from the EEPROM. This security process is set forth in the chart of FIG. 5 wherein the blocks with double borders identify the steps taken by the manufacturer and the single border blocks are the user steps of resetting a lock.

Figure 6A:
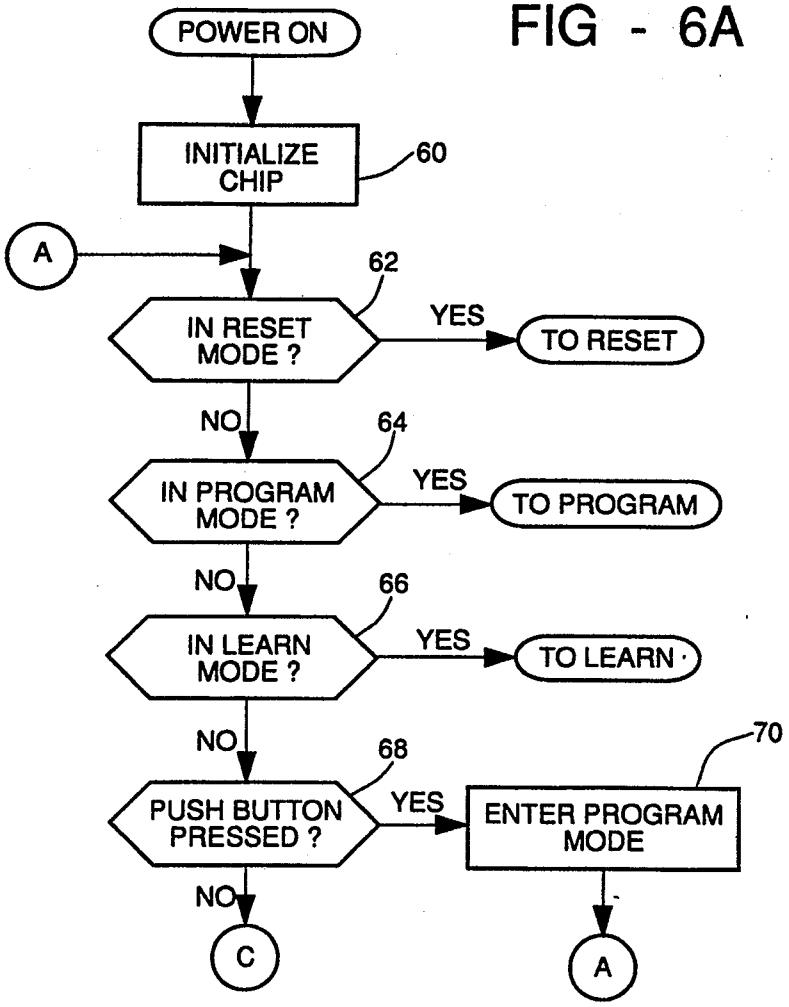
FIGS. 6*a*, 6*b*, 7, 8, 9, 10, and 11 are flow charts representing a program for the microcomputer of FIG. 4 according to the invention.

The microcomputer program is represented by the flow charts of FIGS. 6*a*–11. In the flow chart descriptions, numerals in angle brackets <nn> identify the functions of blocks bearing the corresponding reference numerals. FIGS. 6*a* and 6*b*, which are joined at node C, show the overall program for the microcomputer in programming master codes, learning access codes, resetting all codes and opening the lock. When power is first turned on the microcomputer is initialized <60> by setting all flags to zero, reading the contents of the EEPROM 58 into the internal RAM, and setting the program to Idle mode. The program has four mutually exclusive modes, Idle, Reset, Program, and Learn. The program then checks whether it is in Reset mode <62>, Program mode <64> or Learn mode <66>. Since it is not in any of those modes, it determines whether the pushbutton 34 is pressed <68>. If it is, the Program mode is entered <70> by setting a Program flag and reverting to node A to again check for mode status. If the push button is not pressed, the microcomputer determines whether a New Button flag has been set <72>. If there is a New Button, the key code is compared with the reset code <74> and if there is a match the Reset mode is entered <76>. If there is no match, it is compared with the master code <78> and if a match is found there the Learn mode is entered <80>. If the master code is not matched, the key code is compared with each of the access codes <82> and if there is a match the cabinet is unlocked <84>. If there are no code matches, or there is no new button present <72>, the program enters a routine to determine whether a new button has been inserted. It checks whether there is a button in the socket 16 by checking whether a key code is being input <86>; if not the Button In flag is set to zero <88>. If a button is in the socket, and the Button In flag is not already set to 1 <90>, then it is set to 1 and the New Button flag is set as well <92>, otherwise the New Button flag is reset to zero and the program returns to node A. Thus the New Button flag is allowed for just one loop of the program and then it is reset.

Figure 7:
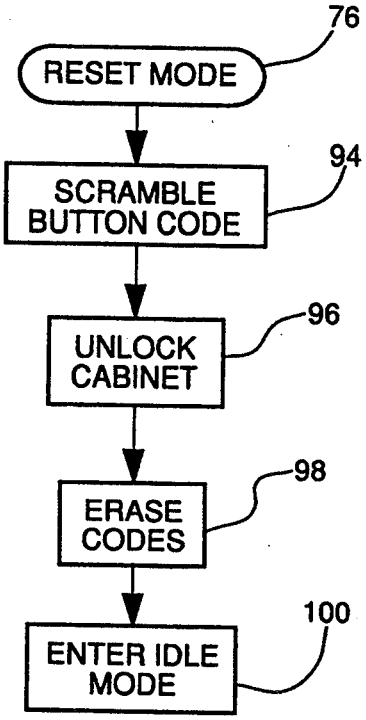

If during the progress through the program loop a Reset, Program or Learn mode flag is set, then the corresponding routine is entered during the next loop. In Reset mode, the program of FIG. 7 is entered. First, the button code is scrambled by the microprocessor and written to the button to thereby give the reset button a new code so that it can no longer serve to reset the lock <94>. Next, the cabinet is unlocked <96> and then the access and master codes in the EEPROM are erased <98>. Finally, Idle mode is entered <100>.

Figure 8:
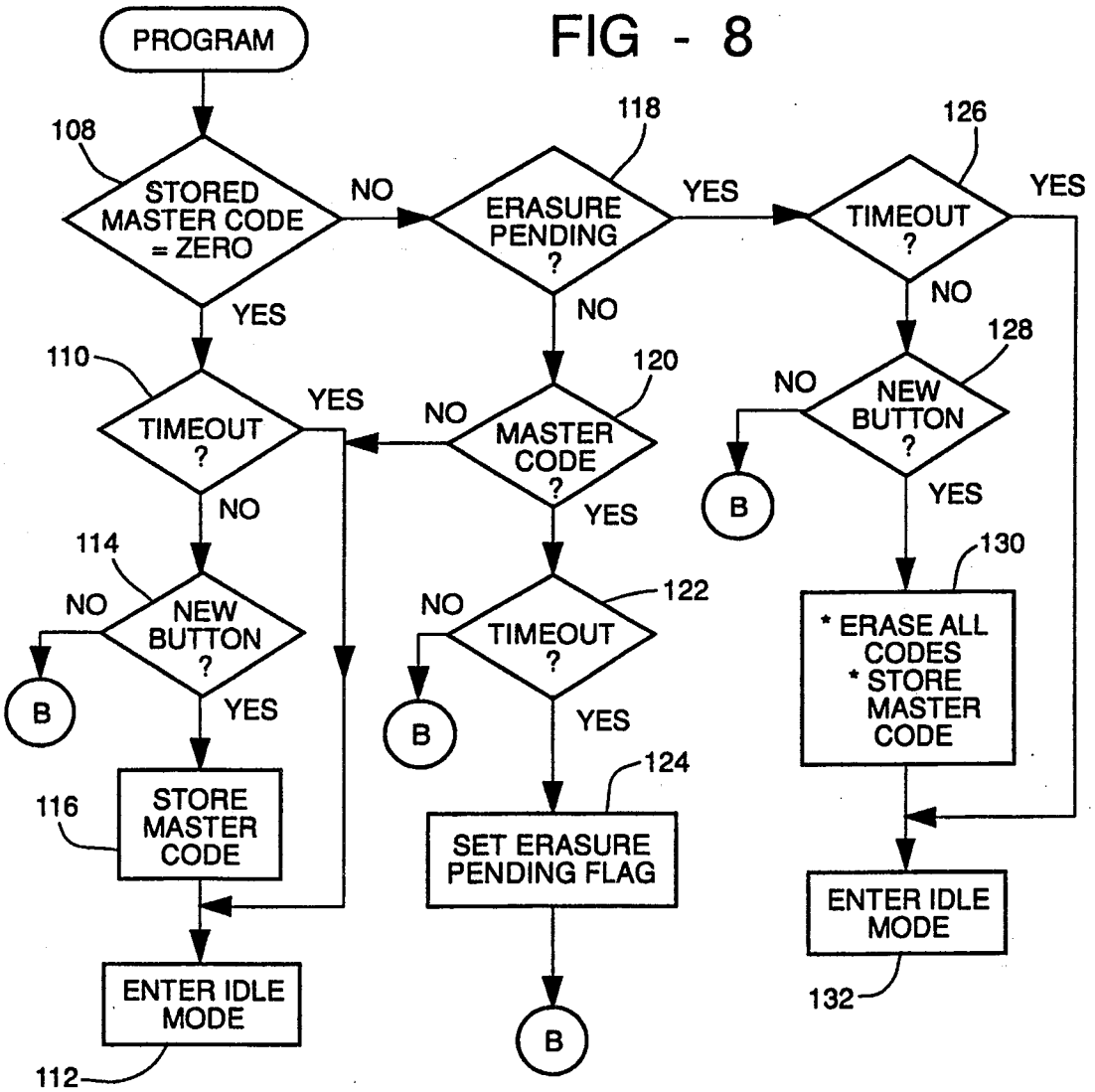

In Program mode, the program illustrated in FIG. 8 is entered. Program mode has two aspects. First, if the unit is new with factory settings or it has just been reset, it has no master code and the Program mode will install one. Second, if the unit has a master code, it can be changed using the master key. In the first case, the master code will be zero <108> or some other specified default value. After the pushbutton 34 is pressed, a button 17 must be placed in the socket 16 within a set time period. If this time expires <110>, the program returns to Idle mode <112>. If the time has not expired, the New Button flag is checked <114> and if it is set, the key code of the button is stored in the EEPROM as the master code <116> and that button becomes the master button for that lock. Then the program returns to Idle mode <112>. If the New Button flag is not set <114> the program returns to node B.

To change the master code, and to erase the access codes as well, the master button must be present for a given time, say, 3 seconds, and then within a second period, say, 30 seconds, a "new button" must be presented, albeit the old master button can be reused for this purpose, if desired. Thus in the second case of the Program mode when the master code is not zero <108>, an Erasure Pending flag is checked <118>. Initially it will not be set. Then if the master code is present <120> long enough for the three second timer to time out <122>, the Erasure Pending flag will be set <124> and the program proceeds to the node B. Subsequent program loops will check the Erasure Pending flag <118> and then test the 30 second timer <126>; if it has not timed out and a New Button flag is set <128> by presenting a button to the lock, all access codes and the master code will be erased and the present key code is installed to become the master code <130>. Then the Idle mode will be entered <132>. If the 30 second timer times out <126>, the Idle mode is entered <132>.

Figure 9:
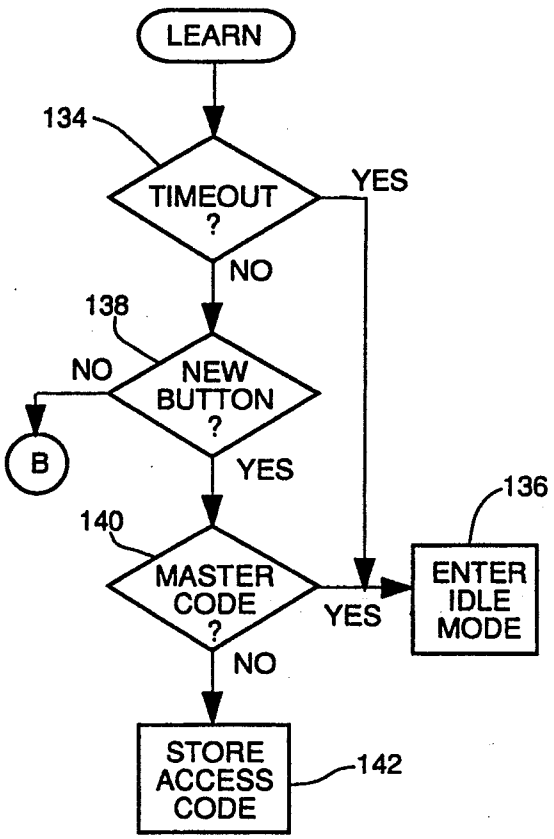

The Learn mode will store the key code of any key other than the master button if it is timely presented to the lock after the Learn mode is entered. As shown in FIG. 9, the Learn mode first checks for timeout <134> and if it has expired the Idle mode is entered <136>. If the time has not expired <134> and a New Button flag is presented <138>, and the new code is not the master code <140>, the new code is stored as an access code <142>. When there is no New Button code <138> the program goes to the node B, or if the key code of the new button is the master code, Idle mode is entered <136>.

Figure 10:
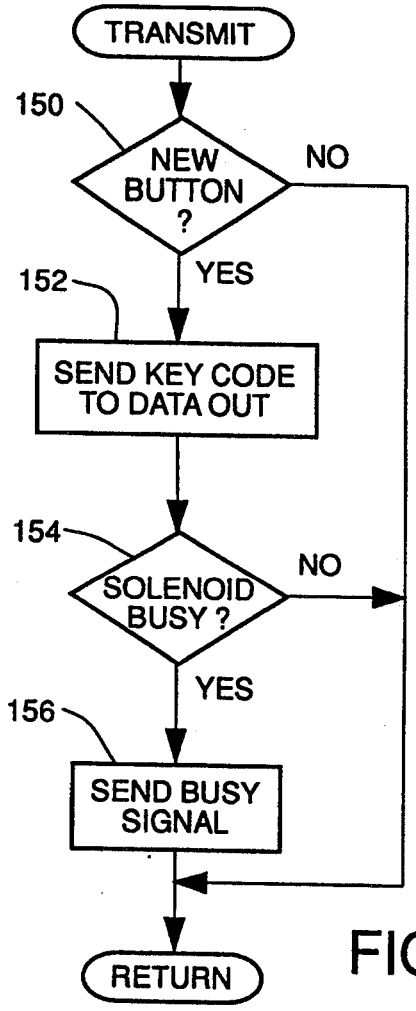

The response of the microprocessor to the data received from a button, as described above, is different from the response to the data transmitted over the transmission lines 28. As shown in FIG. 10, the transmission of data is triggered by a New Button flag <150>. When that flag is set the key code of the button is directed to the data out port for transmission to other units <152>. If, as a result of responding to the key code, the solenoid is being activated to unlock the unit <154>, a busy signal is sent over the line 30 <156>. Rather than transmit the key code from every new button, it may be desired to transmit only those codes which are valid access codes for the unit reading the button code. In that case the block 150, instead of checking the New Button flag, should check for a special Access flag which would be set in response to block 82 of FIG. **6*b*** which checks for the match with an access code.

Figure 11:
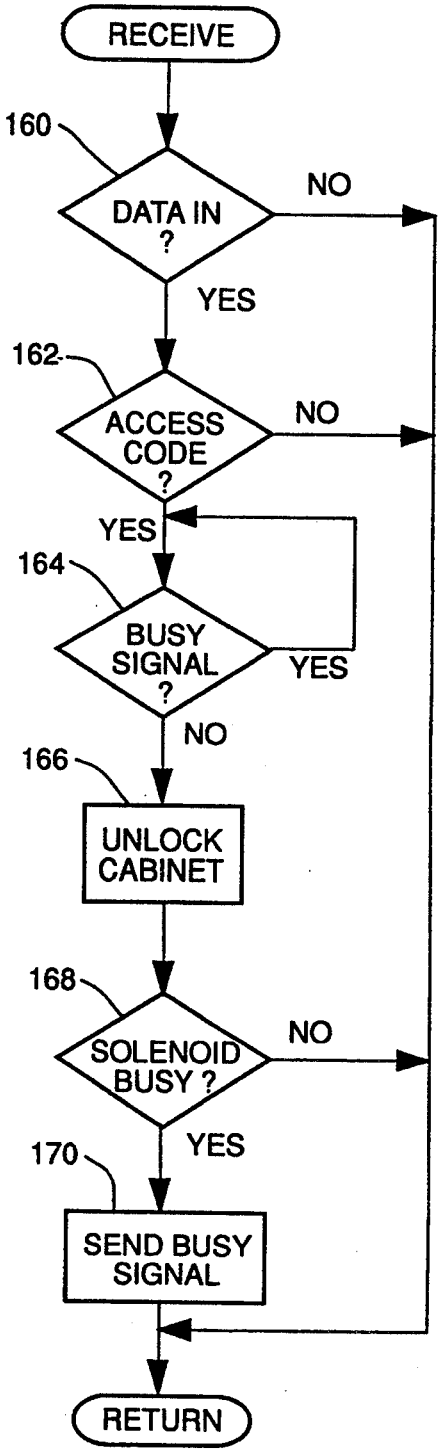

FIG. 11 shows the response of other locks to the transmitted key code. When a key code is received at the data in port <160> the code is compared to the access codes of the receiving lock <162>. If there is a match with an access code, and a busy signal is also received, the program waits until the busy signal turns off <164>. Then the unit is unlocked <166> and as long as its solenoid is busy <168> a busy signal is sent over line 30 <170>.

It will thus be seen that the use of a one-time reset button or key enables an electronic lock to be reprogrammed when its master button or key is lost, yet does not compromise security. The procedure for obtaining the reset key insures that only authorized personnel can obtain it. The method of using the reset key neutralizes the reset code and thus negates any risk of resetting the lock after the one use.

The embodiments of the invention in which an exclusive property or privilege is claimed are defined as follows:

1. In a lockable unit having a lock system comprising an electronic lock having a nonvolatile memory containing a permanent reset code and addresses for user programmed master code and access codes, keys each having a single permanent key code, and circuit means for reading key codes of the keys and for comparing key codes with the lock codes; a method of operating and resetting the lock comprising the steps of:

reading a key code from one of the keys into memory at a master code address to establish a master code;

reading a key code from another key into memory at an access code address to establish an access code.

encoding a programmable reset key with the reset code; subsequently presenting a key to the lock, reading it key code and sequentially comparing its key code to the access code, the master code and the reset code;

opening the lock if the key code of the presented key matches any of the reset, master and access codes;

then, if the key code of the presented key matches the reset code, determining the presented key is the reset key;

erasing the memory at the master code and access code addresses; and disabling the reset function of the reset key by altering the key code of the reset key.

2. The method as defined in claim 1 wherein the unit has a serial number corresponding to the reset code, and the encoding step comprises;

determining the reset code from the serial prior to encoding said reset key with the reset code.

3. In a lockable unit having a lock system comprising an electronic lock having a pushbutton located within the unit and accessible only when the lock is open, a nonvolatile memory containing a permanent reset code, and having addresses for user programmed master code and access codes, key each having a single permanent key code, and circuit means for reading key codes of the keys and for comparing key codes with the lock codes; a method of operating and resetting the lock comprising the steps of:

programming a master code into memory by operating the pushbutton, presenting a first key to the lock, and storing the key code of the first key at the master code address to establish the first key as a master key;

reprogramming a master code into memory by operating the pushbutton, presenting the first key to the lock, then presenting a second key to the lock, erasing the code at the master code address, and writing the key code of the second key at the master code address to establish the second as said master key;

programming an access code into memory by first presenting said master key to the lock and within a short time period presenting a third key to the lock, and writing the key code of the third key to the access code address;

encoding a reset key by programming the reset code into said reset key;

presenting a key to the lock and comparing its key code to the reset, access and master codes and opening the lock if a code match is made;

resetting the lock when the unit is locked and the pushbutton is not accessible if the key code of the presented key matches the reset code in the memory, then determining the key is the reset key erasing the code from the master code address, and removing the reset code from the reset key.

4. The method as defined in claim 3 wherein the unit has a serial number corresponding to the reset code, and an algorithm for deriving the reset code from the serial number is maintained at a secure location, and the encoding step comprises;

determining the reset code from the serial number; and encoding said reset key with the reset code.

5. An electronically controlled lock system for a lockable unit comprising:

a lock including a microcomputer based circuit having a nonvolatile memory containing a permanent reset code and having addresses for a master code and at least one access code;

a plurality of keys containing permanent key codes including a master key and at least one access key;

the circuit includes means for reading the keys and recording key codes for the master and access codes in memory, and for subsequently reading the keys and comparing the respective key codes to codes recorded in memory;

means for opening the lock when an access key is presented to the lock and its key code matches a stored access code; and means for providing a one-time use reset key with the reset code; and means for opening the lock, erasing the access and master codes from the memory, and changing the key code in the reset key when the reset key is presented to the lock and its key code matches the stored reset code.

6. The lock system as defined in claim 5 wherein the means for providing a one-time reset key includes:

means for revealing the reset code of the lock; and means for encoding a key with the recorded reset code.

* * * * *